US007097043B2

(12) United States Patent
Hsu

(10) Patent No.: US 7,097,043 B2
(45) Date of Patent: Aug. 29, 2006

(54) PACKAGING CARTON

(75) Inventor: Feng-Ling Hsu, Pa Te (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 356 days.

(21) Appl. No.: 10/798,564

(22) Filed: Mar. 12, 2004

(65) Prior Publication Data

US 2005/0023162 A1 Feb. 3, 2005

(30) Foreign Application Priority Data

Jul. 31, 2003 (TW) ..... 92121048 A

(51) Int. Cl.
*B65D 75/00* (2006.01)
*B65D 25/04* (2006.01)

(52) U.S. Cl. ..... 206/784; 206/320; 206/588; 206/592; 206/593; 229/120.04; 229/120.18; 229/194

(58) Field of Classification Search ..... 206/736, 206/45.21–45.27, 320, 305, 521, 723, 586–588, 206/591–594, 784, 485, 724; 229/120.04, 229/120.18, 120.21, 120.13, 194
See application file for complete search history.

(56) References Cited

U.S. PATENT DOCUMENTS

| | | | | |
|---|---|---|---|---|
| 2,869,770 | A * | 1/1959 | Bass | 229/117.14 |
| 3,310,219 | A * | 3/1967 | Dlugopolski | 229/117.12 |
| 4,438,848 | A * | 3/1984 | Montealegre et al. | 206/588 |
| 4,832,190 | A * | 5/1989 | Favreau | 206/320 |
| 5,065,935 | A * | 11/1991 | Mancel | 229/136 |
| 2004/0000500 | A1 * | 1/2004 | Hsu | 206/486 |

* cited by examiner

*Primary Examiner*—Mickey Yu
*Assistant Examiner*—Steven Pollicoff
(74) *Attorney, Agent, or Firm*—Rabin & Berdo, PC

(57) ABSTRACT

A packaging carton is disclosed, suitable for packaging an electronic product, such as a peripheral product, a mobile phone, or a spare part. The packing carton is formed by folding a paper material and is one piece, and is fabricated by linking two clip slots. Furthermore, the packaging carton comprises two hollow buffer structures beside two sides of a storage chamber and two upper holding pieces adjacent to both sides of the storage chamber to protect an object packaged in the packaging carton.

23 Claims, 5 Drawing Sheets

PACKAGING CARTON

FIELD OF THE INVENTION

The present invention relates to a packaging carton, and more particularly, to a packaging carton fabricated by a buffer method of linking two clip slots.

BACKGROUND OF THE INVENTION

Inside most of the daily-used packaging cartons, protective packaging structures exist to support and protect the objects disposed in the packaging cartons, thereby avoiding damage resulted from external impact. Inside the commonly-used packaging cartons, the frequently-used materials forming the protective packaging structures are, for example, plastic, paper, and metal. Of these, paper is quite popularly selected for manufacturing the packaging structures because it is easily processed, has a low technical threshold, is cheap, and is easily printed on.

In addition, based on the principle of environmental protection, the packaging structures of paper can be produced from reprocessed paper pulp and be recycled. Moreover, unlike other materials, paper materials do not need to bear the cost of recycling. Therefore, the utilization of paper materials can reduce the impact to ecological environment and have the advantage of low cost.

For highly precise and fairly fragile electrical components, since they are quite easily damaged during transportation by external interference, such as water, dust, impact and so on, the requirements for the packaging structure are stricter. To reduce the damage to objects during transportation, capabilities, such as waterproof, dust-proof, and shock-proof, are built into the protective packaging structure. Currently, a popular method is to insert lots of paper or plastic lining materials, foamed plastic fillers, or foamed cushioning pads into a packaging carton, so as to prevent damage caused by shaking and collision with walls of the packaging carton during transportation to protect the objects therein. Materials of plastic lining materials, foamed plastic fillers and foamed cushioning pads generally are expanded polyethylene (EPE) or polyvinyl chloride (PVC).

Nevertheless, with the promoting of the environmental protection awakening, the use of plastic lining materials, foamed plastic fillers or foamed cushioning pads impacts the environment ecology and cannot fit the environmental protection policy of each country.

The fabrication technique of paper packaging structures is by directly hot-pressing paper pulp into a mold. Another method is to cut cardboard into various planks by first sampling and drawing parallel lines according to the size of the required object; and then folding and pasting the planks according to the required style to fabricate the inner spacer required.

However, the producing method of packaging structures by directly hot-pressing paper pulp into a mold requires development and fabrication of the mold, so that the cost is increased. In addition, the packaging structure made by folding and pasting paper sheets has the drawbacks of poor impact-resistibility, and takes more time to produce.

SUMMARY OF THE INVENTION

An objective of the present invention is to provide a packaging carton formed by folding a paper material and suitable for packing an electronic product, such as peripheral products of a notebook, a mobile phone, or spare parts, and thus reduces the environmental burden and meets the requirements of environmental protection.

Another objective of the present invention is to provide a packaging carton formed by linking two clip slots, and thus simplifying consumables and reducing the cost. Furthermore, the saved cost can be calculated according to the containing area of a product.

Still another objective of the present invention is to provide a packaging carton formed by folding a paper material and in one piece. Therefore, the packaging carton is formed easily, thereby reducing production cost.

According to the aforementioned objectives of the present invention, the present invention provides a packaging carton comprising: a bottom plate, wherein the bottom plate comprises a first embedded slot and a second embedded slot; a first side plate fixedly connected to a first side of the bottom plate, wherein a front edge of the first side plate includes a first front protrusion, and the first side plate comprises: a first clip piece located on a side of the first side plate, wherein the first clip piece comprises a lower embedded slot; and a first fixed piece located on another side of the first side plate opposite the side where the first clip piece located; a second side plate fixedly connected to a second side of the bottom plate opposite the first side plate, wherein a front edge of the second side plate includes a second front protrusion, and the second side plate comprises: a second clip piece located on a side of the second side plate, wherein the second clip piece comprises an upper embedded slot; and a second fixed piece located on another side of the second side plate opposite the side where the second clip piece located, wherein, when the first side plate and the second side plate are folded upwardly and inwardly, the first side plate and the second side plate form a first hollow buffer structure and a second hollow buffer structure, the first front protrusion is embedded into the first embedded slot of the bottom plate and the second front protrusion is embedded into the second embedded slot of the bottom plate, and the lower embedded slot of the first clip piece and the upper embedded slot of the second clip piece are mutually inserted to form a double-clipped structure, so as to fix the first hollow buffer structure and the second hollow buffer structure; a front side plate fixedly connected to a third side of the bottom plate, wherein the front side plate is folded upwardly and inwardly to form a front side structure, and the front side structure comprises an upper buttoned slot, and the first fixed piece and the second fixed piece are inserted into the front side structure, and a storage chamber is constituted between the front side structure, the first hollow buffer structure, the double-clipped structure and the second hollow buffer structure; and an upper cover plate fixedly connected to a fourth side of the bottom plate, wherein a front edge of the upper cover plate comprises a lock piece, and when the upper cover plate is folded upwardly and inwardly to cover the first hollow buffer structure, the second hollow buffer structure, the double-clipped structure and the front side structure, the lock piece can be inserted into the upper buttoned slot.

According to a preferred embodiment of the present invention, the bottom plate further comprises a third embedded slot located between the bottom plate and the first side plate, a fourth embedded slot located between the bottom plate and the second side plate, and a fifth embedded slot located between the bottom plate and the front side plate for being inserted into by a first lower holding piece of the first side plate, the second lower holding piece of the second side plate and a protrusion of the front side plate, respectively, so as to fix the first hollow buffer structure, the second hollow buffer structure and the front side structure.

The packaging carton of the present invention is formed by folding a paper plate and in one piece, and is fabricated by linking two clip slots. Furthermore, the packaging carton comprises hollow buffer structures. Therefore, the production process can be simplified, the consumables and the cost of the packaging carton can be reduced, and the requirement of environmental protection can be met.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention discloses a packaging carton formed by folding a paper material and in one piece, and the packaging carton is assembled by a buffer method of linking two clip slots. Therefore, in addition to be fabricated easily, the kinds of materials consumed in fabrication of the packaging carton can be simplified, the cost thereof can be reduced, and the requirement of environmental protection can be met. In order to make the illustration of the present invention more explicitly and completely, the following description is given in conjunction with the drawings from FIG. 1 to FIG. 5 are stated.

Figure 1:
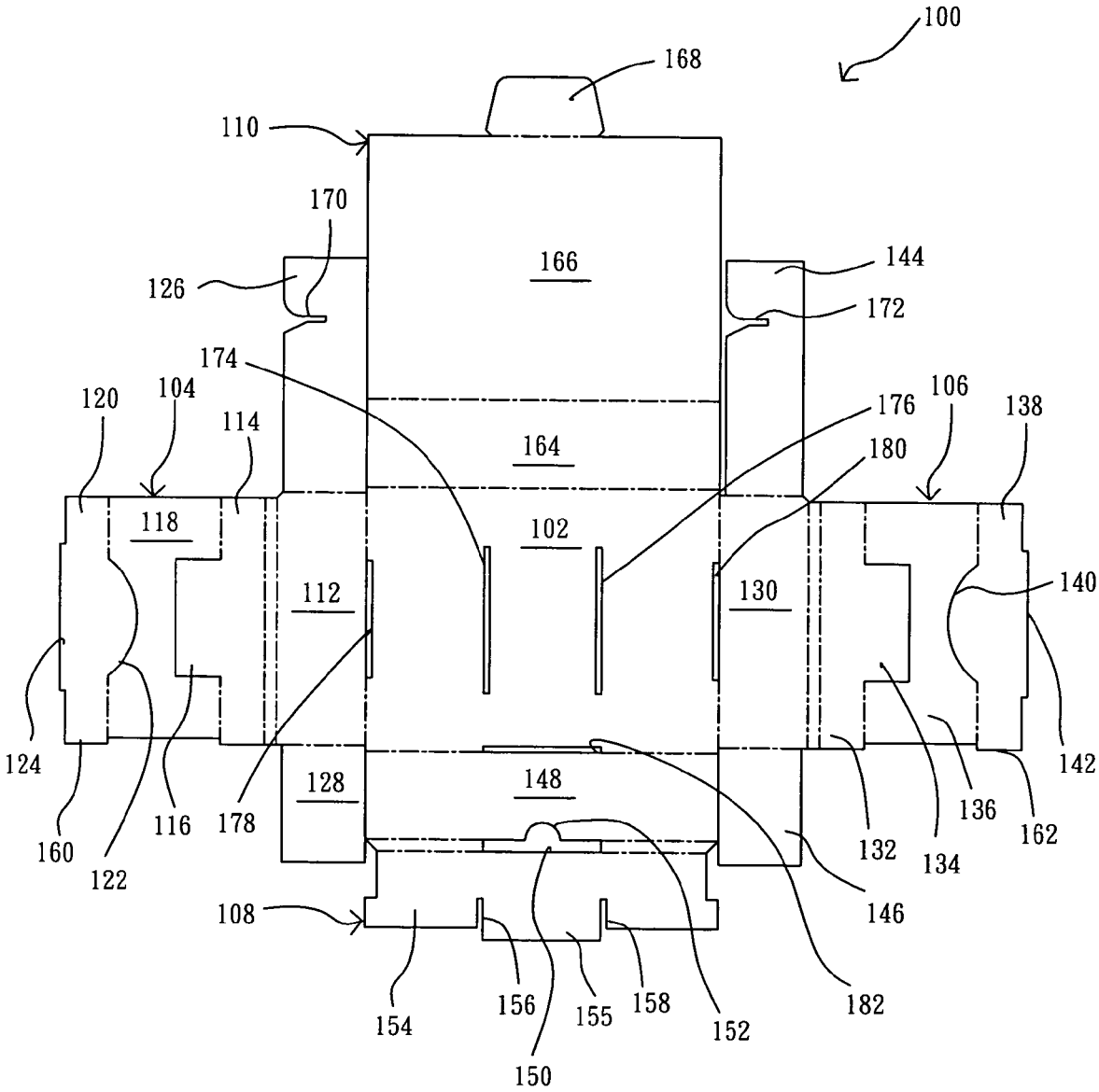
FIG. 1 is a diagram showing an unfolded packaging carton in accordance with a preferred embodiment of the present invention.

Referring to FIG. 1, FIG. 1 is a diagram showing an unfolded packaging carton in accordance with a preferred embodiment of the present invention. A material of the packaging carton is preferable a paper material having a buffer structure, such as corrugated paper. The packaging carton 100 comprises a bottom plate 102, a side plate 104 and a side plate 106 fixedly connected to two sides of the bottom plate 102, respectively, a front side plate 108 fixedly connected to a front side of the bottom plate 102, and a rear side plate 110 fixedly connected to a rear side of the bottom plate 102.

The side plate 104 comprises an outer side piece 112, a sustaining piece 114, an upper side piece 118 and an inner side piece 120 connected in sequence, and a clip piece 126 and a fixed piece 128, respectively connected to two short sides of the outer side piece 112. The outer side piece 112 is connected to the bottom plate 102, the clip piece 126 and the rear side plate 110 are located at the same side, and the fixed piece 128 and the front side plate 108 are located at the same side. The sustaining piece 114 comprises a protruding lower holding piece 116, and the inner side piece 120 comprises a front protrusion 124 located on a front edge of the inner side piece 120, an upper holding piece 122 opposite the front protrusion 124 and a side protrusion 160 located on the same side as the fixed piece 128.

Similar, the side plate 106 comprises an outer side piece 130, a sustaining piece 132, an upper side piece 136 and an inner side piece 138 connected in sequence, and a clip piece 144 and a fixed piece 146, respectively connected to two short sides of the outer side piece 130. The outer side piece 130 is connected to the bottom plate 102, the clip piece 144 and the rear side plate 110 are located at the same side, and the fixed piece 146 and the front side plate 108 are located at the same side. The sustaining piece 132 comprises a protruding lower holding piece 134, and the inner side piece 138 comprises a front protrusion 142 located on a front edge of the inner side piece 138, an upper holding piece 140 opposite the front protrusion 142, and a side protrusion 162 located on the same side as the fixed piece 146.

The front side plate 108 comprises a front side piece 148 and a front side piece 154, wherein the front side piece 148 is fixedly connected to the bottom plate 102, and the front side piece 154 is fixedly connected to the front side piece 148. The front side piece 148 comprises an upper buttoned slot 150 and an opening hole 152. The upper buttoned slot 150 is located between the front side piece 148 and the front side piece 154, and the opening hole 152 is connected to the upper buttoned slot 150. A front edge of the front side piece 154 comprises a protrusion 155, and a fixed slot 156 and a fixed slot 158 located on two sides of the protrusion 155.

The rear side piece 110 comprises a rear side piece 164, an upper cover piece 166 and a lock piece 168, wherein the rear side piece 164 is connected to the bottom plate 102. The size of the upper cover piece 166 is approximately equal to that of the bottom plate 102. The bottom plate 102 comprises an embedded slot 174, an embedded slot 176, an embedded slot 178, an embedded slot 180 and an embedded slot 182. The embedded slot 174, the embedded slot 176, the embedded slot 178 and the embedded slot 180 are parallel, the embedded slot 178 is located between the bottom plate 102 and the side plate 104, the embedded slot 180 is located between the bottom plate 102 and the side plate 106, and the embedded slot 182 is located between the bottom plate 102 and the front side plate 108.

Figure 2:
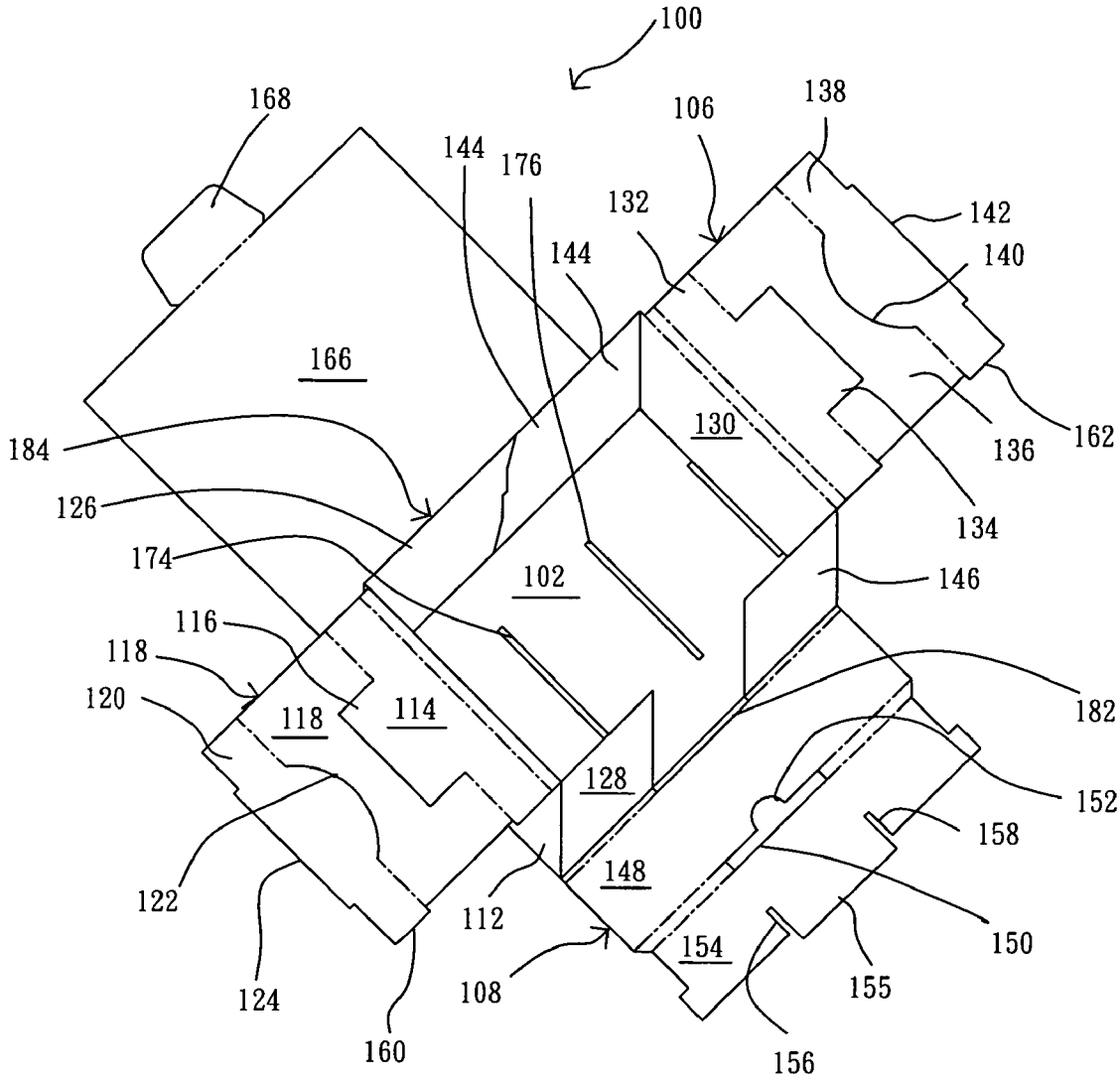
FIG. 2 to FIG. 5 are assembly diagrams showing a packaging carton in accordance with a preferred embodiment of the present invention.

Referring to FIG. 2 and FIG. 5, FIG. 2 to FIG. 5 are assembly diagrams showing a packaging carton in accordance with a preferred embodiment of the present invention. In the assembly of the packaging carton, the clip piece 126 and the clip piece 144 are first folded inwardly to insert the lower embedded slot 170 of the clip piece 126 into the upper embedded slot 172 of the clip piece 144 to form a double-clipped structure 184, as illustrated in FIG. 2.

Figure 3:
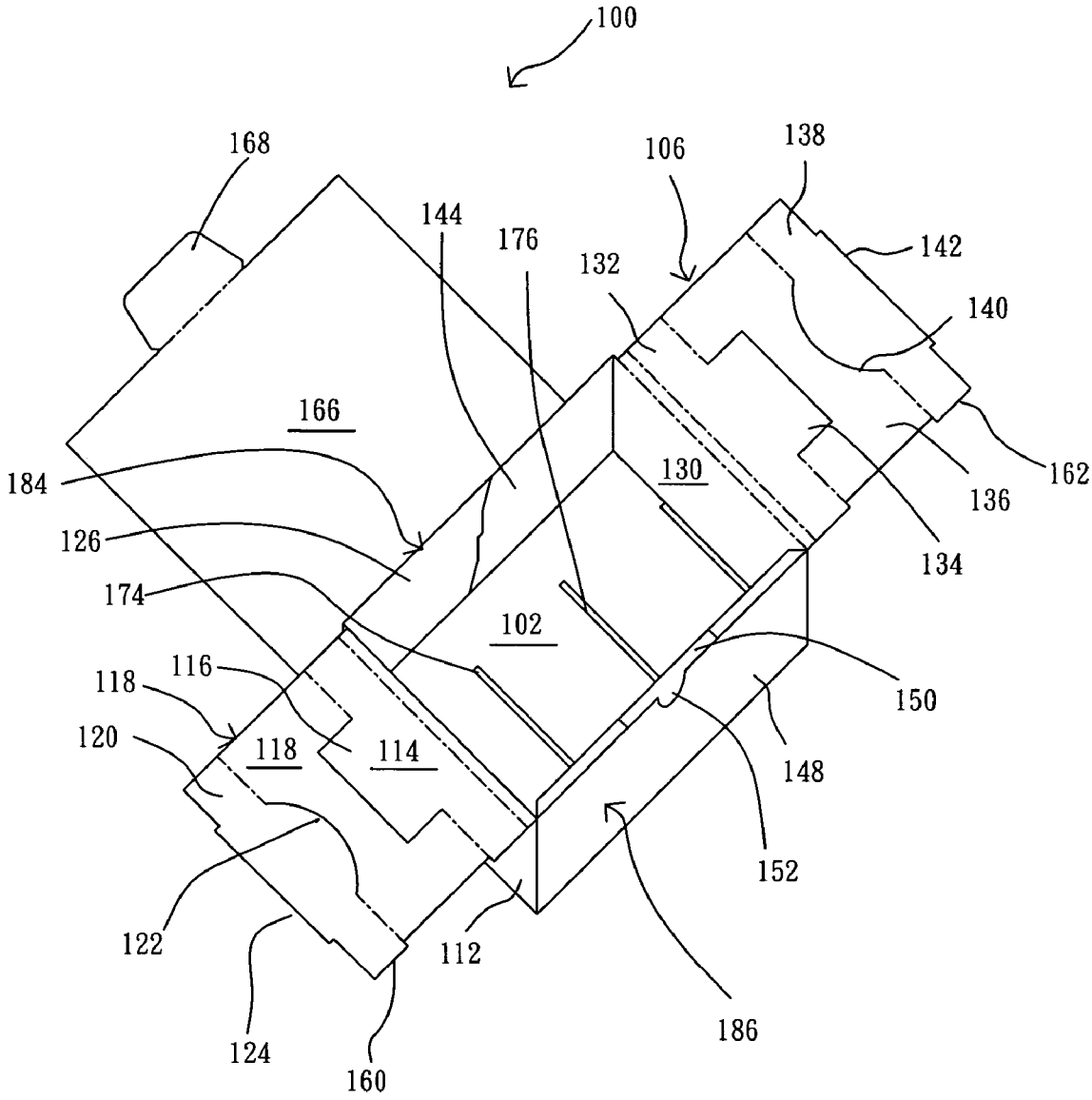

Next, the front side plate 108 is folded upwardly and inwardly to double up the front side piece 154 and the front side piece 148 so as to form a front side structure 186. When the front side piece 154 and the front side piece 148 are folded, the fixed piece 128 of the side plate 104 and the fixed piece 146 of the side plate 106 are sandwiched between the front side piece 154 and the front side piece 148, and the protrusion 155 located on the front edge of the front side piece 154 is inserted into the embedded slot 182 of the bottom plate 102, so as to fix the front side structure 186, as illustrated in FIG. 3. After the front side structure 186 is formed, the upper buttoned slot 150 is upward, and the opening hole 152 is located in a front side of the front side structure 186 under the upper buttoned slot 150.

Figure 4:
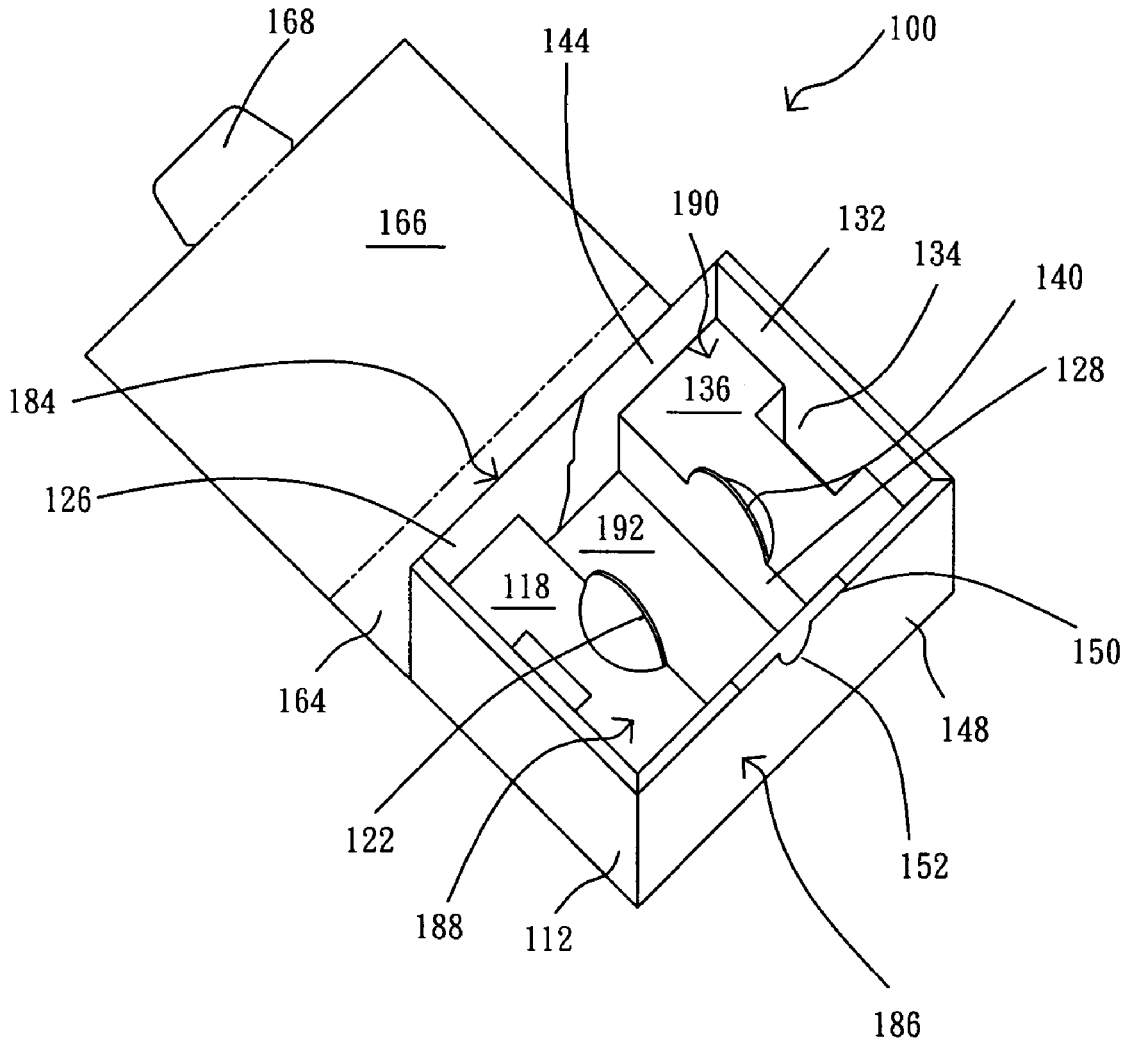

Referring to FIG. 4, after the front side structure 186 is formed, the side plate 104 and the side plate 106 are folded. Since either the side plate 104 or the side plate 106 can be folded first, the folding sequence of the side plate 104 and the side plate 106 is not limited in the present invention. When the side plate 104 is folded, the outer side piece 112 and the sustaining piece 114 are doubled up to form a side structure, the lower holding piece 116 of the sustaining piece 114 is inserted into the embedded slot 178 between the bottom plate 102 and the side plate 104, the front protrusion 124 of the inner side piece 120 is inserted into the embedded slot 174 of the bottom plate 102, the side protrusion 160 of the inner side piece 120 is inserted into the fixed slot 156 of the front side piece 154, and the upper holding piece 122 of the inner side piece 120 is upward, so as to form a hollow buffer structure 188 on a side of the bottom plate 102. A height of the upper holding piece 122 is preferably the same as a height of the side structure composed of the outer side piece 112 and the sustaining piece 114. By using the clip piece 126, the fixed piece 128, the lower holding piece 116, the front protrusion 124, the side protrusion 160, the embedded slot 178, the embedded slot 174 and the fixed slot 156, the hollow buffer structure 188 can be fixed.

When the side plate 106 is folded, the outer side piece 130 and the sustaining piece 132 is doubled up to form a side structure, the lower holding piece 134 of the sustaining piece 132 is inserted into the embedded slot 180 between the bottom plate 102 and the side plate 106, the front protrusion 142 of the inner side piece 138 is inserted into the embedded slot 176 of the bottom plate 102, the side protrusion 162 of the inner side piece 138 is inserted into the fixed slot 158 of the front side piece 154, and the upper holding piece 140 of the inner side piece 138 is upward, so as to form a hollow buffer structure 190 on another side of the bottom plate 102. A height of the upper holding piece 140 is preferably the same as a height of the side structure composed of the outer side piece 130 and the sustaining piece 132. By using the clip piece 144, the fixed piece 146, the lower holding piece 134, the front protrusion 142, the side protrusion 162, the embedded slot 180, the embedded slot 176 and the fixed slot 158, the hollow buffer structure 190 can be fixed.

At present, the assembly of the packaging carton 100 is approximately finished, and a storage chamber 192 is constituted between the hollow buffer structure 188, the hollow buffer structure 190, the double-clipped structure 184 and the front side structure 186, as illustrated in FIG. 4.

Figure 5:
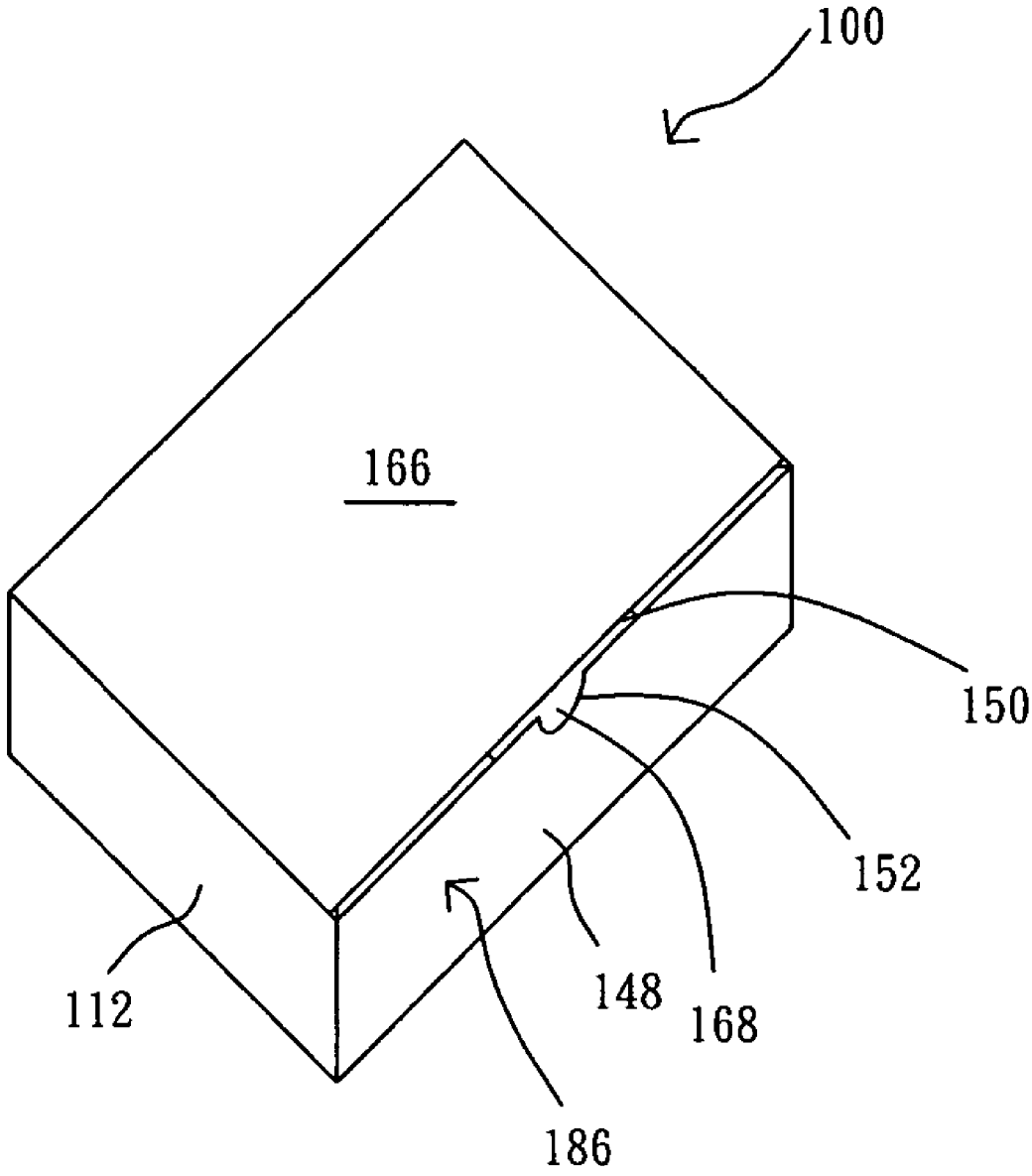

Subsequently, a packed object, such as a peripheral product of a notebook, a mobile phone or a spare part, which is slightly smaller than the storage chamber 192, can be put into the storage chamber 192. The size of the packaging carton 100 can be adjusted according to the size of the packed object. Then, the upper cover plate 110 of the packaging carton 100 is closed to make the rear side piece 164 cover the double-clipped structure 184 and make the upper cover piece 166 cover the hollow buffer structure 188, the hollow buffer structure 190, the front side structure 186, the double-clipped structure 184 and the storage chamber 192. Next, the lock piece 168 is inserted into the upper buttoned slot 150 to button up the upper cover plate 110 and complete the package, as illustrated in FIG. 5.

In the packaging carton 100, with the opening hole 152 located in the front side of the front side structure 186, the upper cover plate 110 can be easily opened. Furthermore, there are hollow buffer structure 188, the hollow buffer structure 190, the double-clipped structure 184, the front side structure 186, the upper holding piece 122 and the upper holding piece 140 around the storage chamber 192, so a better buffer effect and a better protection can be provided for the packed object in the storage chamber 192 to reduce the possibility of damage caused by the external force impacting on the stored object. Moreover, the sustaining piece 114 and the sustaining piece 132 of the two side structure further comprise the lower holding piece 116 and the lower holding piece 134, respectively, so the structural intensity can be increased. In the preferred embodiment of the present invention, since the packaging carton 100 is formed by folding a single paper plate, the packaging carton 100 is formed in one piece and assembled easily, and the materials consumed in the manufacture of the packaging carton 100 are reduced.

According to the aforementioned description, one advantage of the present invention is that the packaging carton of the present invention is formed by folding a paper material, and the environmental burden is thus reduced and the requirement of environmental protection is met.

According to the aforementioned description, another advantage of the present invention is that the packaging carton of the present invention is formed by a buffer method of linking two clip slots, so the consumed materials and cost can be decreased, and the saved cost can be calculated according to the area of the packaging carton.

According to the aforementioned description, still another advantage of the present invention is that because the packaging carton of the present invention is formed by folding a paper material and in one piece, the packaging carton is assembled easily, and the objective of reducing production cost is achieved.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structure.

What is claimed is:

1. A packaging carton, comprising:

a bottom plate, wherein the bottom plate comprises a first embedded slot and a second embedded slot;

a first side plate fixedly connected to a first side of the bottom plate, wherein a front edge of the first side plate includes a first front protrusion, and the first side plate comprises:

a first clip piece located on a side of the first side plate, wherein the first clip piece comprises a lower embedded slot; and a first fixed piece located on another side of the first side plate opposite the side where the first clip piece is located;

a second side plate fixedly connected to a second side of the bottom plate opposite the first side plate, wherein a front edge of the second side plate includes a second front protrusion, and the second side plate comprises:

a second clip piece located on a side of the second side plate, wherein the second clip piece comprises an upper embedded slot; and a second fixed piece located on another side of the second side plate opposite the side where the second clip piece is located, wherein when the first side plate and the second side plate are folded upwardly and inwardly, the first side plate and the second side plate, respectively form a first hollow buffer structure and a second hollow buffer structure, the first front protrusion is embedded into the first embedded slot of the bottom plate and the second front protrusion is embedded into the second embedded slot of the bottom plate, and the lower embedded slot of the first clip piece and the upper embedded slot of the second clip piece are mutually inserted to form a double-clipped structure, so as to fix the first hollow buffer structure and the second hollow buffer structure;

a front side plate fixedly connected to a third side of the bottom plate, wherein the front side plate is folded upwardly and inwardly to form a front side structure, the front side structure comprises an upper buttoned slot, the first fixed piece and the second fixed piece are inserted into the front side structure, and a storage chamber is constituted between the front side structure, the first hollow buffer structure, the double-clipped structure and the second hollow buffer structure; and an upper cover plate fixedly connected to a fourth side of the bottom plate, wherein a front edge of the upper cover plate comprises a lock piece, and when the upper cover plate is folded upwardly and inwardly to cover the first hollow buffer structure, the second hollow buffer structure, the double-clipped structure and the front side structure, the lock piece is inserted into the upper buttoned slot.

2. The packaging carton according to claim 1, wherein the bottom plate further comprises a third embedded slot located between the bottom plate and the first side plate, a fourth embedded slot located between the bottom plate and the second side plate, and a fifth embedded slot located between the bottom plate and the front side plate.

3. The packaging carton according to claim 2, wherein the first side plate further comprises a first outer side piece, a first sustaining piece, a first upper side piece and a first inner side piece connected in sequence, and the first outer side piece is connected to the bottom plate, and the second side plate further comprises a second outer side piece, a second sustaining piece, a second upper side piece and a second inner side piece connected in sequence, and the second outer side piece is connected to the bottom plate.

4. The packaging carton according to claim 3, wherein the first outer side piece and the first sustaining piece are folded to form a first side structure.

5. The packaging carton according to claim 3, wherein the first sustaining piece comprises a first lower holding piece located on a side opposite a connected side of the first outer side piece and the first sustaining piece, and the first lower holding piece is inserted into the third embedded slot of the bottom plate after the first outer side piece and the first sustaining piece are folded.

6. The packaging carton according to claim 3, wherein the second outer side piece and the second sustaining piece are folded to form a second side structure.

7. The packaging carton according to claim 3, wherein the second sustaining piece comprises a second lower holding piece located on a side opposite a connected side of the second outer side piece and the second sustaining piece, and the second lower holding piece is inserted into the fourth embedded slot of the bottom plate after the second outer side piece and the second sustaining piece are folded.

8. The packaging carton according to claim 3, wherein the front side plate comprises a first front side piece and a second front side piece, and the first front side piece and the second front side piece are folded to form the front side structure.

9. The packaging carton according to claim 8, wherein the first front side piece comprises a protrusion, and the protrusion is inserted into the fifth embedded slot of the bottom plate after the first front side piece and the second front side piece are folded.

10. The packaging carton according to claim 1, wherein the upper cover plate further comprises a rear side piece and an upper cover piece connected in sequence, and after the upper cover plate is closed, the rear side piece covers a rear side of the double-clipped structure and the upper cover piece covers the first hollow buffer structure, the second hollow buffer structure, the front side structure, the storage chamber and the double-clipped structure.

11. The packaging carton according to claim 1, wherein a material of the packaging carton is a paper plate having a buffer structure.

12. A packaging carton, comprising:

a bottom plate, wherein the bottom plate comprises a first embedded slot and a second embedded slot;

a first hollow buffer structure, comprising sequentially connected:

a first outer side structure fixedly connected to a first side of the bottom plate;

a first upper side piece; and a first inner side piece, wherein the first inner side piece comprises a first front protrusion located on a front edge of the first inner side piece, and the first front protrusion is inserted into the first embedded slot of the bottom plate to fix the first hollow buffer structure;

a first clip plate located on a side of the first outer side structure, wherein the first clip plate comprises a lower embedded slot;

a second hollow buffer structure, comprising sequentially connected:

a second outer side structure fixedly connected to a second side of the bottom plate opposite the first hollow buffer structure;

a second upper side piece; and a second inner side piece, wherein the second inner side piece comprises a second front protrusion located on a front edge of the second inner side piece, and the second front protrusion is inserted into the second embedded slot of the bottom plate to fix the second hollow buffer structure, and a storage chamber is located between the second inner side piece and the first inner side piece;

a second clip plate located on a side of the second outer side structure, wherein the second clip plate comprises an upper embedded slot, and the lower embedded slot of the first clip plate and the upper embedded slot of the second clip plate are mutually inserted to form a double-clipped structure, so as to fix the first hollow buffer structure and the second hollow buffer structure;

a front side structure fixedly connected to a third side of the bottom plate, wherein the front side structure comprises an upper buttoned slot; and an upper cover plate fixedly connected to a fourth side of the bottom plate, wherein a front edge of the upper cover plate comprises a lock piece, and when the upper cover plate is folded upwardly and inwardly to cover the double-clipped structure, the first hollow buffer structure, the second hollow buffer structure and the front side structure, the lock piece is inserted into the upper buttoned slot.

13. The packaging carton according to claim 12, wherein the bottom plate further comprises a third embedded slot located between the bottom plate and the first side plate, a fourth embedded slot located between the bottom plate and the second side plate, and a fifth embedded slot located between the bottom plate and the front side plate.

14. The packaging carton according to claim 13, wherein the first outer side structure comprises a first outer side piece and a first sustaining piece connected in sequence, and the second side structure comprises a second outer side piece and a second sustaining piece connected in sequence.

15. The packaging carton according to claim 14, wherein the first sustaining piece comprises a first lower holding piece located on a side opposite a connected side of the first outer side piece and the first sustaining piece, and the first lower holding piece is inserted into the third embedded slot of the bottom plate after the first outer side piece and the first sustaining piece are folded.

16. The packaging carton according to claim 14, wherein the second sustaining piece comprises a second lower holding piece located on a side opposite a connected side of the second outer side piece and the second sustaining piece, and the second lower holding piece is inserted into the fourth embedded slot of the bottom plate after the second outer side piece and the second sustaining piece are folded.

17. The packaging carton according to claim 13, wherein the front side structure comprises a first front side piece and a second front side piece, the second front side piece is connected to the first front side piece and the bottom plate, and the first front side piece and the second front side piece are folded to form the front side structure.

18. The packaging carton according to claim 17, wherein the first front side piece comprises a protrusion, and the protrusion is inserted into the fifth embedded slot of the bottom plate after the first front side piece and the second front side piece are folded.

19. The packaging carton according to claim 12, wherein the first inner side piece comprises a first upper holding piece located on another side opposite a side where the first front protrusion is located, and a height of the first upper holding piece is equal to a height of the first side structure after the first hollow buffer structure is formed.

20. The packaging carton according to claim 12, wherein the second inner side piece comprises a second upper holding piece located on another side opposite a side where the second front protrusion located, and a height of the second upper holding piece is equal to a height of the second side structure after the second hollow buffer structure is formed.

21. The packaging carton according to claim 12, wherein the upper cover plate further comprises a rear side piece and an upper cover piece connected in sequence, and after the upper cover plate is closed, the rear side piece covers a rear side of the double-clipped structure and the upper cover piece covers the first hollow buffer structure, the second hollow buffer structure, the front side structure, the storage chamber and the double-clipped structure.

22. The packaging carton according to claim 12, wherein a material of the packaging carton is a paper plate having a buffer structure.

23. The packaging carton according to claim 12, wherein a material of the packaging carton is corrugated paper.

* * * * *